US006621479B2

(12) United States Patent
Kikuchi

(10) Patent No.: US 6,621,479 B2
(45) Date of Patent: Sep. 16, 2003

(54) ACTIVE MATRIX LIQUID CRYSTAL DISPLAY DEVICE

(75) Inventor: Koji Kikuchi, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 157 days.

(21) Appl. No.: 09/849,850

(22) Filed: May 4, 2001

(65) Prior Publication Data

US 2001/0040567 A1 Nov. 15, 2001

(30) Foreign Application Priority Data

May 11, 2000 (JP) ..... 2000-143410

(51) Int. Cl.[7] ..... G09G 3/36

(52) U.S. Cl. ..... 345/98; 345/100; 345/92; 345/96

(58) Field of Search ..... 345/87, 88, 89, 345/94, 95, 96, 97, 98, 99, 100, 211, 208, 209, 210

(56) References Cited

U.S. PATENT DOCUMENTS 4,697,887 A 10/1987 Okada et al. ..... 345/96
4,937,566 A 6/1990 Clerc ..... 345/92

*Primary Examiner*—Xiao Wu
(74) *Attorney, Agent, or Firm*—Brinks Hofer Gilson & Lione

(57) ABSTRACT

An active matrix liquid crystal display device includes a thin film transistor (TFT) array substrate and a counter electrode substrate with a liquid crystal layer held therebetween. On a surface of the counter electrode substrate adjacent to the liquid crystal layer, a plurality of counter electrodes are formed perpendicular to gate lines on the TFT array substrate. Each of the counter electrodes faces at least one column of pixel electrodes connected to drain electrodes of the TFTs.

15 Claims, 6 Drawing Sheets

ACTIVE MATRIX LIQUID CRYSTAL DISPLAY DEVICE

BACKGROUND OF THE INVENTION

1. Field of the Invention

The present invention generally relates to active matrix liquid crystal display devices, and more particularly to a configuration in which counter electrodes face pixel electrodes with a liquid crystal layer therebetween.

2. Description of the Related Art

Typically, a liquid crystal display device includes a TFT array substrate 54, as shown in FIG. 5, having thin film transistors and pixel electrodes, and a counter electrode substrate 56, as shown in FIG. 6, having counter electrodes facing the pixel electrodes, with a liquid crystal layer (not shown) being held therebetween.

The TFT array substrate 54 includes a plurality of gate lines 51, a plurality of data lines 52, a plurality of thin film transistors 53 formed in the vicinity of intersections of the gate lines 51 and the data lines 52, and pixel electrodes 57 individually connected to the plurality of thin film transistors 53.

On the other hand, the counter electrode substrate 56 facing the TFT array substrate 54 simply includes a single counter electrode 55 common to all the pixel electrodes 57.

A signal voltage from the data lines 52 is applied to the pixel electrodes 57 formed on the TFT array substrate 54 via the thin film transistors 53. A power supply 59 is connected to the counter electrode 55 formed on the counter electrode substrate 56 through a plurality of connector terminals 58. Although two connector terminals 58 are shown in FIG. 5, at least one connector terminal 58 is required, and the connector terminal 58 may be disposed at any location. This allows a liquid crystal layer (not shown) to be driven by using a voltage difference between the pixel electrodes 57 and the common electrode 55.

In the above-mentioned liquid crystal display device, a voltage applied to the counter electrode 55 is selected to be $V_O$ so that positive voltages and negative voltages are applied to the liquid crystal layer in a symmetric manner, as illustrated in FIG. 7, in order to avoid a flicker or display failure which results from the sticking phenomenon (image retention) when the liquid crystal display device is driven.

Recently, the demand for such a liquid crystal display device with high definition display has been increasing. As a result, the number of intersections between the gate lines 51 and the data lines 52, and the number of thin film transistors 53 connected to the gate lines 51 are drastically being increased. The gate lines 51 exhibit parasitic capacitance at locations such as at the intersections with the data lines 52 and the gate electrodes of the thin film transistors 53 in the vicinity of the intersections.

Therefore, as the desire for higher definition display increases, such capacitance in the gate lines 51 is increased, thus increasing signal delay in the gate lines 51.

When a signal delay occurs in the gate lines 51, the signal waveform of the gate electrodes becomes rounded, and the thin film transistors 53 suffer from the leakage of charge at the timing when they are turned off.

The leakage of charge at the thin film transistors 53 is greater at portions further from gate signal sources. Hence, the further the thin film transistors are from the gate signal sources, the greater the leakage becomes.

Accordingly, the amount of variation in voltage applied to the pixel electrodes 57, which depends upon the leakage of charge at the thin film transistors 53, is also increased at portions of the gate lines 51 that are further from the gate signal sources. Portions 51*a*, 51*b*, 51*c*, 51*d*, and 51*e* of each of the gate lines 51 shown in FIG. 5 extend further from the gate signal source, in the order stated.

When the amount of variation in voltage applied to the pixel electrodes 57 differs depending upon a distance in the gate lines 51 from the gate signal sources, voltages applied to the liquid crystal layer, as indicated by B1 to B5 in FIG. 8, are increased at portions of the gate lines 51 that are further from the gate signal sources in a manner such that |B1*a*| to |B1*b*|), . . . , (|B5*a*| to |B5*b*|). Thus, the applied voltage has less symmetrical polarity.

Less symmetrical polarity may result in problems of flicker or display failure which results from the sticking phenomenon.

SUMMARY OF THE INVENTION

Accordingly, it is an object of the present invention to provide an active matrix liquid crystal display device in which no flicker or sticking of images occurs on a display screen when a signal delay in gate lines causes voltages applied to pixels at portions of the gate lines that are closer to and further from signal sources to differ.

To this end, the present invention provides an active matrix liquid crystal display device including a pair of substrates facing each other with a liquid crystal layer held therebetween. On a surface of one of the substrates adjacent to the liquid crystal layer, there are formed a plurality of gate lines and a plurality of data lines intersecting to form a matrix; thin film transistors in the vicinity of intersections of the gate lines and the data lines, the thin film transistors having gate electrodes connected to the gate lines and source electrodes connected to the data lines; and pixel electrodes connected to the drain electrodes of the thin film transistors. On a surface of the other substrate adjacent to the liquid crystal layer, there are formed a plurality of counter electrodes in the direction perpendicular to the gate lines on the one substrate. Each of the counter electrodes faces at least one column of the pixel electrodes.

Therefore, a voltage is applied at different magnitudes to the plurality of counter electrodes depending upon a distance in the gate lines from signal sources. This prevents a flicker or sticking of images from occurring on a display screen when the amount of variation in voltages applied to the pixel electrodes at portions of the gate lines that are closer to and further from the signal sources differs.

Preferably, the plurality of counter electrodes are connected to power supplies for supplying different voltages, so that the voltages applied to the counter electrodes may be independently set.

Preferably, the plurality of counter electrodes are respectively connected to a plurality of output terminals of a voltage controller connected to a signal power supply to generate different magnitudes of voltage, so that the number of power supplies required may be reduced.

BRIEF DESCRIPTION OF THE DRAWINGS

Some illustrative embodiments of the present invention will be described with reference to the drawings, in which.

DESCRIPTION OF THE PREFERRED EMBODIMENTS

Figure 1:
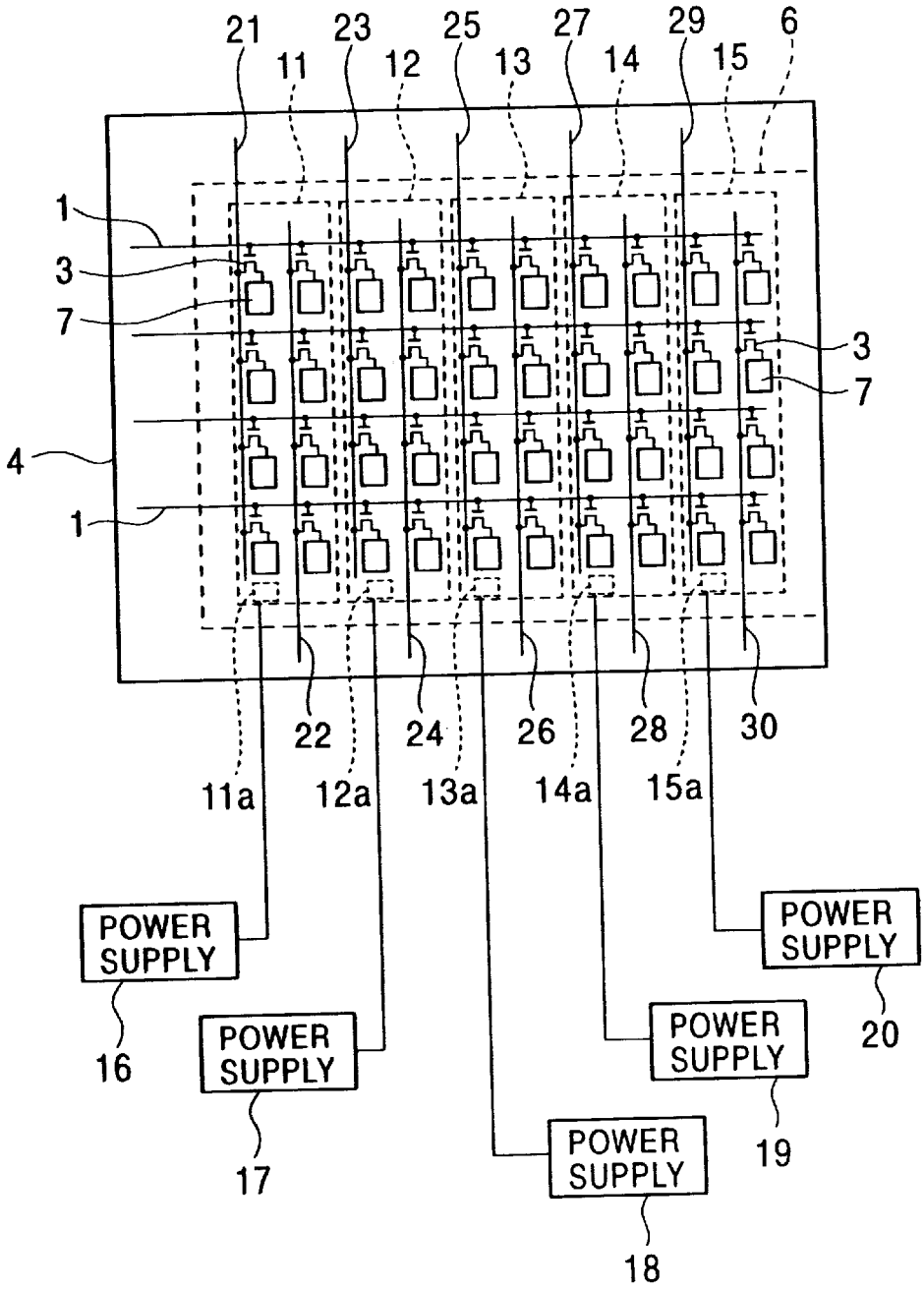
FIG. 1 is an exploded view showing a main portion of an active matrix liquid crystal display device according to a first embodiment of the present invention.
Figure 2:
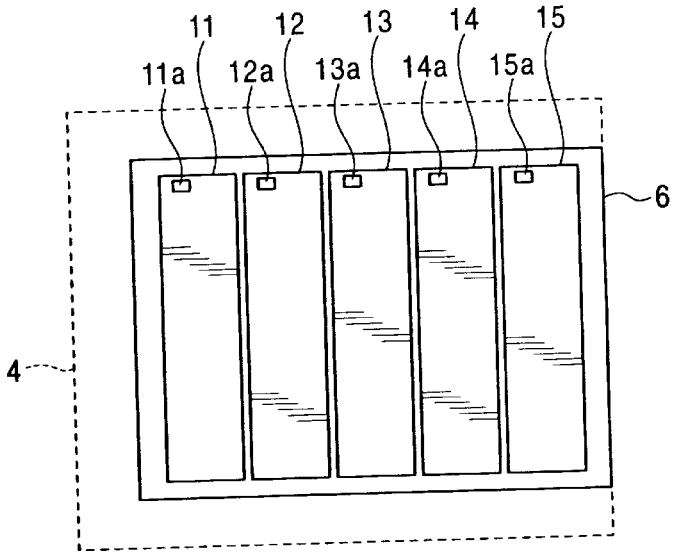
FIG. 2 is an exploded view showing another main portion of the active matrix liquid crystal display device shown in FIG. 1.

FIGS. 1 and 2 are exploded views showing main portions of an active matrix liquid crystal display device according to a first embodiment of the present invention.

Referring to FIGS. 1 and 2, the liquid crystal display device includes a TFT array substrate 4 and a counter electrode substrate 6 facing each other with a liquid crystal layer (not shown) held therebetween. The TFT array substrate 4 includes a plurality of gate lines 1, a plurality of data lines 21, 22, 23, 24, 25, 26, 27, 28, 29, and 30, a plurality of thin film transistors 3 formed in the vicinity of intersections between the gate lines 1 and the data lines 21 to 30, and pixel electrodes 7 individually connected to the thin film transistors 3. The counter electrode substrate 6 contains counter electrodes 11, 12, 13, 14, and 15 which face columns of the pixel electrodes 7 defined by the data lines 21 and 22, 23 and 24, 25 and 26, 27 and 28, and 29 and 30, respectively.

A signal voltage is applied to the pixel electrodes 7 formed on the TFT array substrate 4 from the associated data lines 21 to 30 via the thin film transistors 3. The plurality of counter electrodes 11, 12, 13, 14, and 15 formed on the counter electrode substrate 6 are supplied different voltages from power supplies 16, 17, 18, 19, and 20 via connector terminals 11*a*, 12*a*, 13*a*, 14*a*, and 15*a*, respectively.

Figure 3:
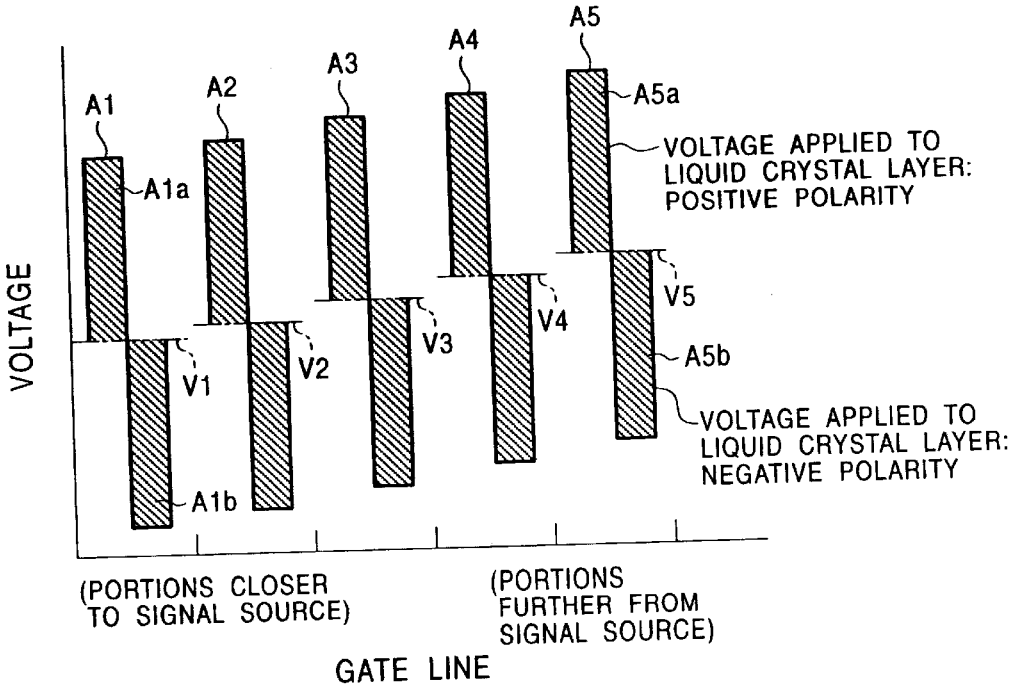
FIG. 3 is a graph showing the operation of the active matrix liquid crystal display device shown in FIG. 1.

As shown in FIG. 3, the voltages applied to the counter electrodes 11, 12, 13, 14, and 15 are selected to be V1, V2, V3, V4, and V5 for columns of the pixel electrodes 7 depending upon a distance in the gate lines 1 from signal sources so that positive voltages and negative voltages are applied to the liquid crystal layer in a symmetric manner such that ($|A1a|=|A1b|$), . . . , ($|A5a|=|A5b|$).

Therefore, even though a signal delay in the gate lines 1 causes voltages applied to the pixel electrodes 7 at portions of the gate lines 1 that are closer to and further from the signal sources to differ, positive voltages and negative voltages are applied to the liquid crystal layer in a symmetric manner. This avoids a flicker or display failure which results from the sticking phenomenon when the present display device is driven.

While five divided counter electrodes, i.e., the counter electrodes 11, 12, 13, 14, and 15 are employed in the first embodiment shown in FIGS. 1 and 2, the number of divided counter electrodes is not limited to this number. The larger the number of divided counter electrodes, the more symmetric the positive and negative voltages applied to the liquid crystal layer.

This feature would be more remarkably exhibited in high definition display of the SVGA class or higher.

A liquid crystal display device according to a second embodiment of the present invention is described with reference to FIG. 4. The liquid crystal display device according to the second embodiment is different from that of the first embodiment in that the counter electrodes 11, 12, 13, 14, and 15 are supplied with different magnitudes of voltage through output terminals 50*a*, 50*b*, 50*c*, 50*d*, and 50*e* of a voltage drop section 50 coupled to a single power supply 49 to generate different fractional voltages.

Figure 4:
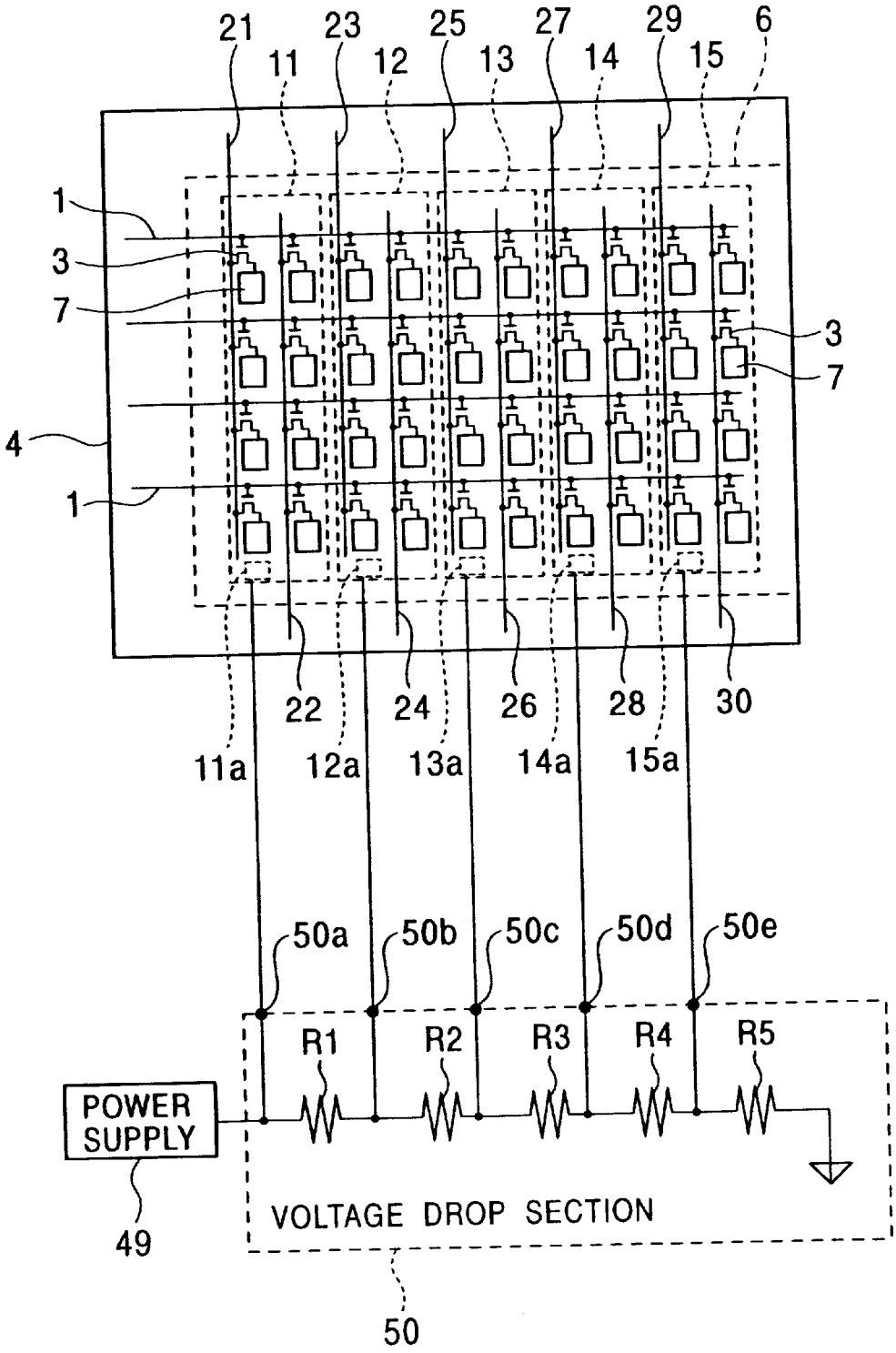
FIG. 4 is an exploded view showing a main portion of an active matrix liquid crystal display device according to a second embodiment of the present invention.
Figure 5:
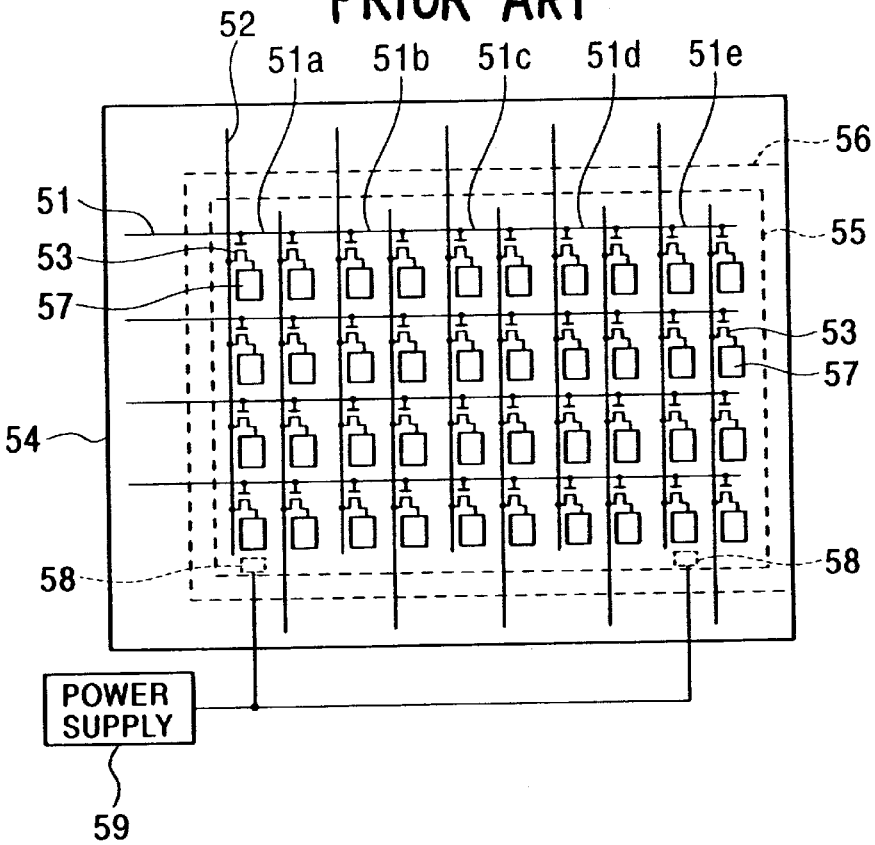
FIG. 5 PRIOR ART
FIG. 5 is an exploded view showing a main portion of a conventional liquid crystal display device.
Figure 6:
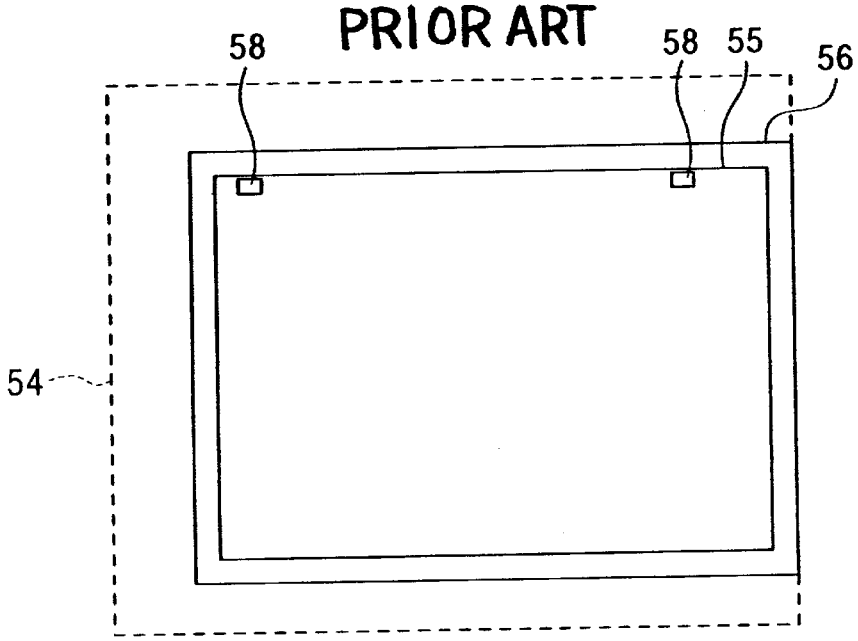
FIG. 6 PRIOR ART
FIG. 6 is an exploded view showing another main portion of the liquid crystal display device shown in FIG. 5.
Figure 7:
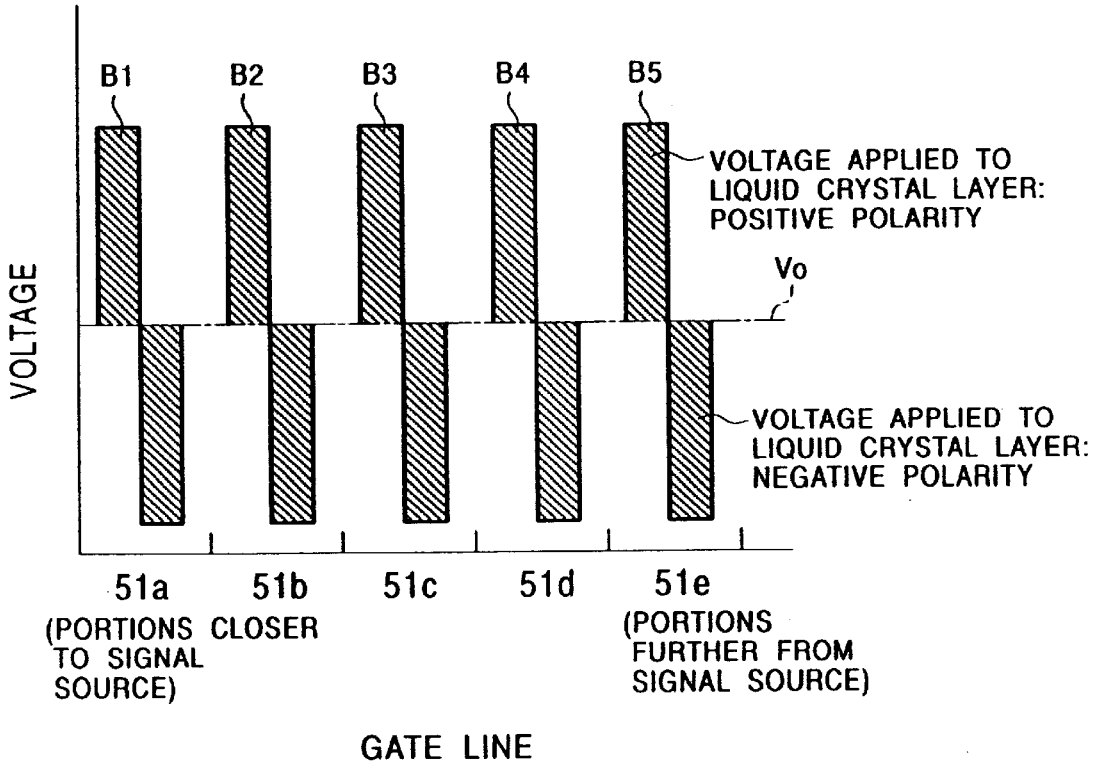
FIG. 7 PRIOR ART
FIG. 7 is a graph showing a operation of the liquid crystal display device shown in FIG. 5.
Figure 8:
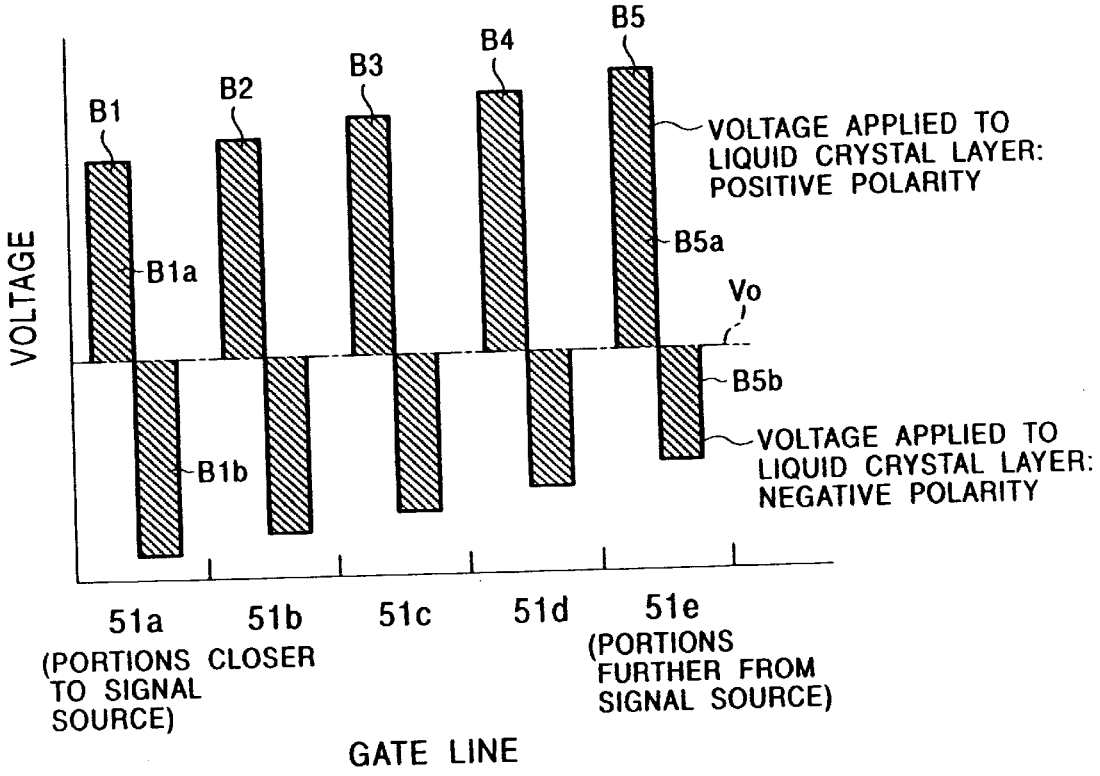
FIG. 8 PRIOR ART
FIG. 8 is a graph showing another operation of the liquid crystal display device shown in FIG. 5.

In the liquid crystal display device according to the second embodiment, the same reference numerals are assigned to the same elements as those of the liquid crystal display device of the first embodiment shown in FIG. 4, and a description thereof is thus omitted.

The plurality of counter electrodes 11, 12, 13, 14, and 15 formed on the counter electrode substrate 6 of the liquid crystal display device shown in FIG. 4 are electrically connected to the output terminals 50*a*, 50*b*, 50*c*, 50*d*, and 50*e* of the voltage drop section 50 via the connector terminals 11*a*, 12*a*, 13*a*, 14*a*, and 15*a*, respectively.

The voltage drop section 50 having one end connected to the power supply 49 and the other end connected to the ground includes resistors R1, R2, R3, R4, and R5 connected in series. Although the other end of the voltage drop section 50 is connected to the ground in FIG. 4, it may be connected to any other terminal with a voltage.

The voltages applied to the plurality of counter electrodes 11, 12, 13, 14, and 15 from the power supply 49 are set to have different magnitudes in the voltage drop section 50. In FIG. 4, the plurality of resistors R1, R2, R3, R4, and R5 are used to generate a voltage drop having different magnitudes. The resistance values of the resistors R1, R2, R3, R4, and R5 are selected for V1, V2, V3, V4, and V5 and for the associated columns of pixel electrodes 7 depending upon a distance in the gate lines 1 from signal sources so that positive voltages and negative voltages are applied to the liquid crystal layer in a symmetric manner, as in FIG. 3.

Therefore, the desired voltage is applied to the plurality of counter electrodes 11, 12, 13, 14, and 15 in order to avoid a flicker or display failure which results from the sticking phenomenon when the present liquid crystal display device is driven, allowing the liquid crystal display device to be driven using voltage differences between the pixel electrodes 7 and the plurality of counter electrodes 11, 12, 13, 14, and 15.

Although the present invention has been described through illustrations of its preferred forms, it is to be understood that the described embodiments are only illustrative and various changes and modifications may be imparted thereto without departing from the scope of the present invention which is limited solely by the appended claims.

What is claimed is:

1. An active matrix liquid crystal display device comprising a pair of substrates facing each other with a liquid crystal layer held therebetween, one of the substrates including:

a plurality of gate lines and a plurality of data lines intersecting to form a matrix;

thin film transistors in a vicinity of intersections of the gate lines and the data lines, the thin film transistors having drain electrodes, gate electrodes connected to the gate lines and source electrodes connected to the data lines; and pixel electrodes connected to the drain electrodes of the thin film transistors, wherein the gate lines, the data lines, the thin film transistors, and the pixel electrodes are formed on a surface of the one substrate adjacent to the liquid crystal layer, the other substrate including, on a surface thereof adjacent to the liquid crystal layer, a plurality of counter electrodes formed in a direction perpendicular to the gate lines on the one substrate, each of the counter electrodes facing at least one column of the pixel electrodes, wherein a magnitude of a voltage applied to a particular counter electrode decreases as the thin film transistors opposing the counter electrode increase in distance from a source of signals to the gate lines.

2. An active matrix liquid crystal display device according to claim 1, wherein the plurality of counter electrodes are respectively connected to power supplies that supply different voltages to each counter electrode.

3. An active matrix liquid crystal display device according to claim 1, wherein the plurality of counter electrodes are respectively connected to a plurality of output terminals of a voltage controller, the voltage controller being connected to a power supply and generating voltages of different magnitudes at different output terminals of the plurality of output terminals.

4. An active matrix liquid crystal display device according to claim 1, wherein a magnitude of a voltage applied to the liquid crystal layer disposed between a particular thin film transistor and a particular counter electrode is independent of a position of the particular thin film transistor.

5. An active matrix liquid crystal display device according to claim 1, wherein voltages applied to the liquid crystal layer disposed between a particular thin film transistor and a particular counter electrode have a symmetric magnitude and alternate polarity.

6. A method of reducing flicker of images in active matrix liquid crystal display device, the method comprising:

providing a plurality of gate lines and a plurality of data lines intersecting to form a matrix, thin film transistors in a vicinity of the intersections, the thin film transistors having drain electrodes, gate electrodes connected to the gate lines and source electrodes connected to the data lines, and pixel electrodes connected to the drain electrodes;

providing a plurality of counter electrodes formed in a direction perpendicular to the gate lines with liquid crystal therebetween, each of the counter electrodes facing at least one column of the pixel electrodes; and decreasing magnitudes of voltages applied to the counter electrodes as a distance of the corresponding thin film transistors increase from a source of signals to the respective gate lines.

7. The method according to claim 6, further comprising supplying different voltages to each counter electrode.

8. The method according to claim 6, further comprising supplying different voltages via a single power supply.

9. The method according to claim 6, further comprising applying a magnitude of a voltage to the liquid crystal layer disposed between a particular thin film transistor and a particular counter electrode independent of a position of the particular thin film transistor.

10. The method according to claim 6, further comprising applying voltages of symmetric magnitude and alternating polarity to the liquid crystal layer disposed between a particular thin film transistor and a particular counter electrode.

11. An active matrix liquid crystal display device comprising a pair of substrates facing each other with a liquid crystal layer held therebetween, one of the substrates including:

a plurality of gate lines and a plurality of data lines intersecting to form a matrix;

thin film transistors in a vicinity of intersections of the gate lines and the data lines, the thin film transistors having drain electrodes, gate electrodes connected to the gate lines and source electrodes connected to the data lines; and pixel electrodes connected to the drain electrodes of the thin film transistors, wherein the gate lines, the data lines, the thin film transistors, and the pixel electrodes are formed on a surface of the one substrate adjacent to the liquid crystal layer, the other substrate including, on a surface thereof adjacent to the liquid crystal layer, a plurality of counter electrodes formed in a direction perpendicular to the gate lines on the one substrate, each of the counter electrodes facing at least one column of the pixel electrodes, wherein a summation of negative and positive voltages are applied in a symmetric manner to the liquid crystal layer changes as the thin film transistors opposing the counter electrode increases in distance from a source of signals to the gate lines.

12. An active matrix liquid crystal display device according to claim 11, further comprises a power supply connected to the particular electrode, wherein the power supply transmits the positive and negative voltages applied to the liquid crystal layer.

13. An active matrix liquid crystal display device according to claim 12, further comprises a plurality of resistors coupled to the power supply and the particular counter electrode.

14. An active matrix liquid crystal display device comprising a pair of substrates facing each other with a liquid crystal layer held therebetween, one of the substrates including:

a plurality of gate lines and a plurality of data lines intersecting to form a matrix;

thin film transistors in a vicinity of intersections of the gate lines and the data lines, the thin film transistors having drain electrodes, gate electrodes connected to the gate lines and source electrodes connected to the data lines; and pixel electrodes connected to the drain electrodes of the thin film transistors, wherein the gate lines, the data lines, the thin film transistors, and the pixel electrodes are formed on a surface of the one substrate adjacent to the liquid crystal layer, the other substrate including, on a surface thereof adjacent to the liquid crystal layer, a plurality of counter electrodes formed in a direction perpendicular to the gate lines on the one substrate, each of the counter electrodes facing at least one column of the pixel electrodes, wherein a magnitude of differing voltages are applied in a symmetric manner to a particular counter electrode as the thin film transistors opposing the counter electrode increases in distance from a source of signals to the gate lines.

15. An active matrix liquid crystal display device comprising a pair of substrates facing each other with a liquid crystal layer held therebetween, one of the substrates including:

a plurality of gate lines and a plurality of data lines intersecting to form a matrix;

thin film transistors in a vicinity of intersections of the gate lines and the data lines, the thin film transistors having drain electrodes, gate electrodes connected to the gate lines and source electrodes connected to the data lines; and pixel electrodes connected to the drain electrodes of the thin film transistors, wherein the gate lines, the data lines, the thin film transistors, and the pixel electrodes are formed on a surface of the one substrate adjacent to the liquid crystal layer, the other substrate including, on a surface thereof adjacent to the liquid crystal layer, a plurality of counter electrodes formed in a direction perpendicular to the gate lines on the one substrate, each of the counter electrodes facing at least one column of the pixel electrodes, wherein a magnitude of a voltage applied to a particular counter electrode changes as the thin film transistors opposing the counter electrode increases in distance from a source of signals to the gate lines.

* * * * *